US009401150B1

(12) United States Patent
Dorenbosch

(10) Patent No.: US 9,401,150 B1
(45) Date of Patent: Jul. 26, 2016

(54) SYSTEMS AND METHODS TO DETECT LOST AUDIO FRAMES FROM A CONTINUOUS AUDIO SIGNAL

(71) Applicant: ANRITSU COMPANY, Morgan Hill, CA (US)

(72) Inventor: Jheroen P. Dorenbosch, Paradise, TX (US)

(73) Assignee: ANRITSU COMPANY, Morgan Hill, CA (US)

( * ) Notice: Subject to any disclaimer, the term of this patent is extended or adjusted under 35 U.S.C. 154(b) by 0 days.

(21) Appl. No.: 14/257,882

(22) Filed: Apr. 21, 2014

(51) Int. Cl.
*G10L 19/005* (2013.01)

(52) U.S. Cl.
CPC ..... *G10L 19/005* (2013.01)

(58) Field of Classification Search
CPC ..... G10L 19/008; G10L 19/24; G10L 19/167; G10L 21/038; G10L 19/005; G10B 20/10527
See application file for complete search history.

(56) References Cited

U.S. PATENT DOCUMENTS

| | | | | |
|---|---|---|---|---|
| 2003/0115515 | A1* | 6/2003 | Curtis | H04L 1/242 714/712 |
| 2004/0124996 | A1* | 7/2004 | Andersen | 340/870.38 |
| 2008/0243277 | A1* | 10/2008 | Kadel | G10L 19/0018 700/94 |
| 2010/0118183 | A1* | 5/2010 | Stevens | 348/441 |
| 2012/0265523 | A1* | 10/2012 | Greer et al. | 704/201 |
| 2012/0269354 | A1* | 10/2012 | Doherty et al. | 381/56 |

* cited by examiner

*Primary Examiner* — King Poon
*Assistant Examiner* — Ibrahim Siddo
(74) *Attorney, Agent, or Firm* — Tucker Ellis LLP

(57) ABSTRACT

A method to detect audio frame losses over a link to a device under test (DUT), such as a User Equipment (UE), includes preparing an input sequence, combining the input sequence into an input audio signal, submitting the input audio signal to an encoder, transporting the encoded signal over the link, obtaining a continuous output audio signal from decoding the transported signal, decomposing the continuous output audio signal into an output sequence, and determining one or more lost frames based on a comparison of one or more characteristics of the input sequence and the output sequence. Preparing the input sequence can include preparing a sequence of a plurality of input snippets, each input snippet having one or more audio characteristics, the preparing such that consecutive input snippets have one or more audio characteristics that differ by a predetermined measure.

16 Claims, 7 Drawing Sheets

SYSTEMS AND METHODS TO DETECT LOST AUDIO FRAMES FROM A CONTINUOUS AUDIO SIGNAL

TECHNICAL FIELD

The present invention relates to transmitting audio and determining a loss in quality of audio transmitted.

BACKGROUND

Telecommunication network operators are regularly tasked with evaluating performance of user equipment (UE) devices, particularly UE devices newly introduced for use in telecommunication applications operating over the operators' networks. Typically, UE devices are assembled by manufacturing partners of the operators and delivered for evaluation. Metrics of concern include the loss of audio and video frames during transmission of audio and video from a UE device over an operator's network to a target recipient. Systems and methods for measuring the loss of audio and video frames would be useful in evaluating performance of UE devices over an operator's network.

SUMMARY

In an embodiment, a method to detect audio frame losses over a link to a device under test (DUT), such as a User Equipment (UE), includes preparing an input sequence, combining the input sequence into an input audio signal, submitting the input audio signal to an encoder, transporting the encoded signal over the link, obtaining a continuous output audio signal from decoding the transported signal via the DUT, decomposing the continuous output audio signal into an output sequence, and determining one or more lost frames based on a comparison of one or more characteristics of the input sequence and the output sequence. Preparing the input sequence can include preparing a sequence of a plurality of input snippets, each input snippet having one or more audio characteristics, the preparing such that consecutive input snippets have one or more audio characteristics that differ by a predetermined measure.

In an embodiment, the encoder encodes the input audio signal into a plurality of audio frames, which frames are transported over the link and the continuous output audio signal is obtained be decoding at least a portion of the audio frames. The continuous output audio signal is decomposed into an output sequence of a plurality of output snippets, where each output snippet corresponds to an input snippet from the plurality of input snippets of the input sequence. One or more audio characteristics of one or more of the output snippets is determined and compared with the one or more audio characteristics of corresponding one or more input snippets. A lost frame is indicated when one or more audio characteristics of an output snippet do not agree with one or more audio characteristics of the corresponding input snippet within a predetermined limit.

In an embodiment, the input snippets include a separator segment to delineate the input snippets within the input sequence. In an embodiment, the input snippets have a duration corresponding to one audio frame duration. In an alternative embodiment, the input snippets have a duration corresponding to a fraction of one audio frame duration. In an embodiment a plurality of output snippets has a duration that is shorter than the duration of the corresponding input snippets.

In an embodiment, an input snippet contains one tone. In an embodiment, the one or more characteristics of the input snippet include an input frequency and the one or more characteristics of the output snippet include an output frequency. Comparing the one or more audio characteristics an output snippets with the one or more audio characteristics of the corresponding input snippet includes comparing the input frequency with the output frequency. Indicating a lost frame when one or more audio characteristics of an output snippets do not agree with one or more audio characteristics of the corresponding input snippet within a predefined limit comprises indicating a lost frame if the output frequency do not agree within the predefined limit.

In an embodiment, indicating a lost frame when one or more audio characteristics of an output snippets do not agree with one or more audio characteristics of the corresponding input snippet within a predefined limit includes indicating a lost frame when the average audio power of the output snippet is less than the average audio power of the input snippet by the predetermined limit.

In an embodiment, preparing the sequence of input snippets includes preparing the sequence of input snippets such that input snippets that are two positions apart in the sequence have one or more audio characteristics that differ by one or both of a predetermined measure. Preparing the sequence of input snippets can further include preparing the sequence of input snippets such that input snippets that are three positions apart in the sequence have one or more audio characteristics that differ by one or both of a predetermined measure.

In an embodiment, the sequence of audio frames is a sequence of adaptive multi-rate (AMR) frames and the decoding is performed by the User Equipment. The continuous audio signal can be obtained from an analog or a digital audio output on the User Equipment.

In an embodiment, a system to detect audio frame losses over a downlink to a User Equipment (UE) comprises an audio signal encoder and one or more micro-processors. The micro-processors are usable to perform embodiments of methods to detect audio frame losses over a link to a device under test (DUT), such as a User Equipment (UE).

DETAILED DESCRIPTION

The following description is of the best modes presently contemplated for practicing various embodiments of the present invention. The description is not to be taken in a limiting sense but is made merely for the purpose of describing the general principles of the invention. The scope of the invention should be ascertained with reference to the claims It would be apparent to one of skill in the art that the present invention, as described below, may be implemented in many different embodiments of hardware, software, firmware, and/or the entities illustrated in the figures. Further, the frame durations and snippet durations, and tone levels used in the figures and description are merely exemplary. Any actual software, firmware and/or hardware described herein, as well as any duration times or levels generated thereby, is not limiting of the present invention. Thus, the operation and behavior of the present invention will be described with the understanding that modifications and variations of the embodiments are possible, given the level of detail presented herein.

Figure 1:
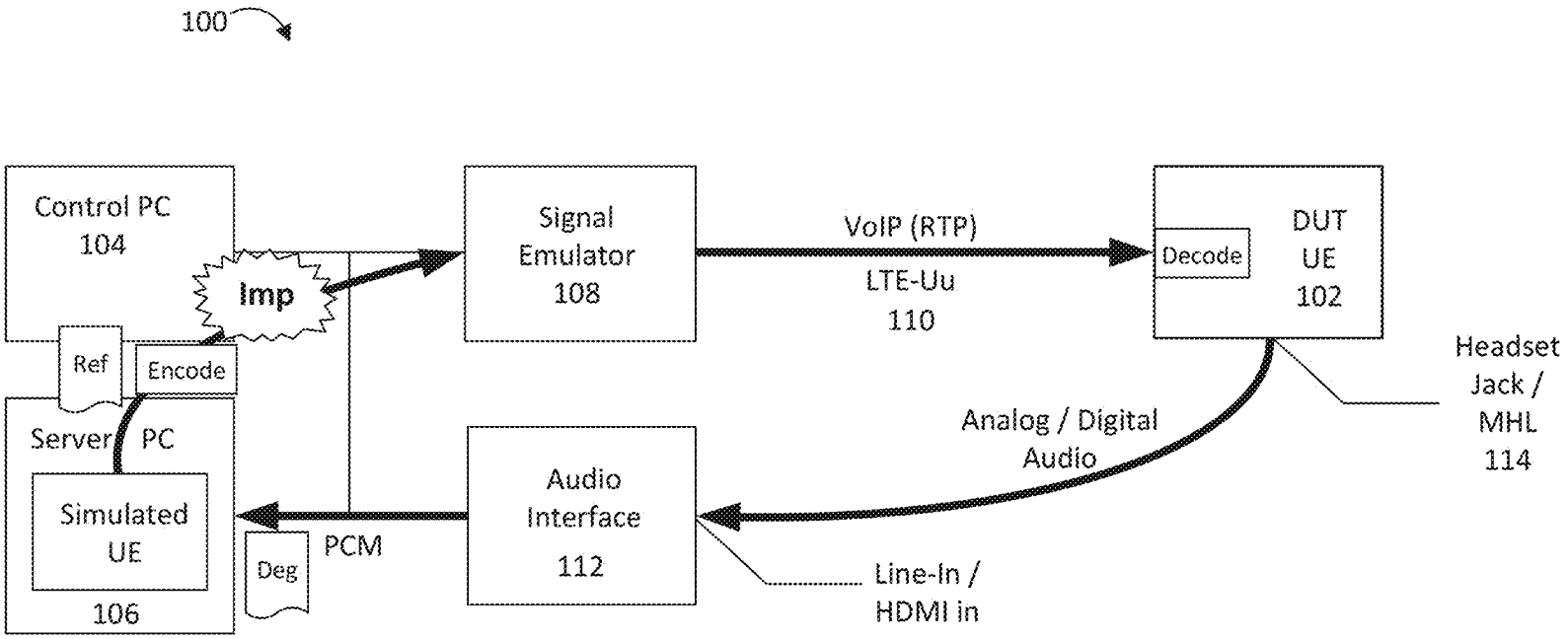
FIG. 1 illustrates a setup for testing quality of transmission of an audio signal.

FIG. 1 illustrates a system 100 for sending audio and video over a link to a device under test (DUT) 102 to test performance of the DUT. As shown, the DUT is a user equipment (UE). The system is usable to execute a frame loss test plan for a link over which audio and video can be sent to and from the UE. In the exemplary system of FIG. 1, a downlink test setup is shown for testing audio performance of the DUT, although one of ordinary skill, upon reflecting on the teaching contained herein, will appreciate that uplink tests and tests of video performance can likewise be performed.

The system includes a pair of personal computers (PCs) 104, 106 and a signal emulator 108, such as a model MD8430A signaling tester available from ANRITSU® Corporation, that emulates a base station for a link based on a telecommunication standard, such as the Long-Term Evolution (LTE) standard. Radio frequency (RF) signals transmitted via the link may travel wirelessly but in a test system they typically travel over cables to the UE. The link interface between a UE and an LTE base station is typically referred to as LTE-Uu, and is shown as such. Many other link technologies may be used such as links based on Universal Mobile Telecommunications System (UMTS) or Code Division Multiple Access (CDMA).

The system can be used to test downlink audio performance, by initiating an LTE voice over internet protocol (VoIP) connection using Real-time Transport Protocol (RTP) and sending input audio from a reference audio file to the UE. The system may also use other protocols to transport digital audio over the link, such as an MP4 download of audio-visual media over evolved Multimedia Broadcast Multicast Services (eMBMS), for example. The input audio can contain standardized speech clips or more technical content, such as beeps and clicks. The audio is sent over the interface in encoded form, where LTE typically uses the Adaptive Multi-Rate Wideband (AMR-WB) codec, which is a wideband speech coding standard. LTE may also use other codecs, such AMR Narrowband (AMR-NB), Extended Multi-Rate Wideband (AMR-WB+), MPEG-2 Audio Layer III (MP3), or Advanced Audio Coding (AAC) and one of skill in the art will appreciated that systems described herein can use any suitable codec.

The input audio signal is encoded by an audio codec in the system to obtain a sequence of audio segments or audio frames which are encapsulated in RTP packets or in other types of packets such as FLUTE packets, SYNC packets or MP4 frames and sent over the LTE connection. With AMR-WB, the audio frames and the RTP packets are produced at a rate of 50 Hz and thus each frame correlates with an audio duration of 20 ms. With other protocols, the audio frames may have different rates, such as 24, 25 or 30 Hz. The interval at which frames are produced is referred to herein as 'frame duration'. The system may or may not intentionally impose impairments on the frames to simulate jitter, packet errors and packet losses. Further frame errors and frame losses may occur on the link or inside the UE.

The UE decapsulates the received packets, buffers the resulting audio frames in a so-called de jitter buffer, and feeds the output of the de jitter buffer to a decoder to obtain an output audio signal. The output audio signal is typically represented as Pulse Code Modulation (PCM) which contains the digital amplitude of the output audio signal sampled at a high rate (e.g. 16 kHz). The PCM can be converted to an analog signal and audibly output at a speaker or electronically output at a headset jack 114 of the UE. Alternatively or additionally, the PCM can be made available in digital form at a universal serial bus (USB) or a Mobile High-Definition Link (MHL)/High-Definition Multimedia Interface (HDMI) output. Whether provided in analog form or digital form, the signal is considered a continuous output audio signal because the audio is no longer encoded in codec frames. The system can use an audio interface 112 to capture the analog or digital audio for further analysis.

The input audio signal can also contains a leader segment that precedes the audio that is to be tested. The leader segment can also be used for timing synchronization. The segment can contain robust signals with an easily recognized time structure. These robust signals will readily appear in the audio output signal because they are less sensitive to frame losses and can be used to time-align the input audio signal with the output audio signal. Alignment accuracy can be of the order of a millisecond.

The de jitter buffer is used to supply a regular steam of audio frames to the decoder, even in the presence of jitter and losses. The implementation of the de jitter buffer is proprietary (i.e, it is not defined by a standard). The de jitter buffer typically imposes a small delay on the packets so that there is time to wait for packets that arrive late because of jitter. There is a maximum delay, so as not to introduce too much latency in the audio signal. When a frame arrives after the maximum delay due to excessive jitter, or if it does not arrive at all, the de jitter buffer indicates a missing frame to the decoder, which then takes corrective action.

The number of missing frames is not equal to the number of frames that was intentionally omitted as impairments imposed by the system (if any). In general it will be higher because of frame errors, losses on the LTE link, losses in the de jitter buffer and errors that may occur in the UE. A performance test can also be run over real wired links and/or real wireless links, and the number of lost frames will not be predictable because of the vagaries of RF propagation. As a result, operators and UE vendors are interested in the measurement of the frame loss rate. When a frame is missing, the decoder can fill in for the missing frame, for example with audio that resembles that of the preceding frames, possibly played at a lower volume. For example, if the previous frame encodes a sine wave with a certain frequency, the decoder will tend to fill in or compensate for the missing frame with a sine wave that has the same frequency as the preceding frame, but with lower amplitude. For this reason it can be hard to reliably determine which frames are lost from a typical continuous audio signal. For example, if a frame is lost in the middle of speech representing the word "aaah", the decoder may fill in with one frame duration worth of "aaa" sound. This makes it very hard to reliably determine the number of lost frames from analyzing the continuous output signal of the UE. A method to reliably detect lost audio codec frames, based on analysis of the continuous analog or digital output audio signal from the decoder would be therefore be beneficial.

Embodiments in accordance with the present invention can include systems and methods for generating a specially constructed input audio signal that is prepared such that it facilitates lost frame detection, as well as the specially constructed signals themselves. The specially constructed input audio signal can comprise a sequence of audio input 'snippets'. The input audio signal can further comprise a leader segment. The input audio signal, or corresponding encoded frames can be stored in a file for later play-out during a call, or can be generated during a call or test run in real time and streamed to the UE.

In an exemplary application of an embodiment of a method, an AMR-WB codec or encoder is used to encode snippets having a duration of 20 ms, each corresponding to one audio frame duration. Each snippet can be presented to the encoder in perfect alignment with the frame time boundaries of the encoder. This is possible because the input audio signal and the encoder are both under control of the system. The input audio signal can comprise consecutive input snippets so that the snippets can be provided to the decoder in consecutive order with the first snippet being provided when the decoder is started (or after it has been preceded by an integer multiple of 20 ms worth of audio), thereby aligning the decoder to the snippets.

In the embodiment, the snippets can be constructed to optimize detection of lost frames. As described above, when the decoder misses an input frame it will fill the void with something that resembles preceding audio. For this reason the snippets are constructed so that each snippet has audio characteristics that differ significantly from the characteristics of the immediately preceding snippet. Different snippets may correspond, for example, to different vowels or consonants, or may contain different tones, different di-tones, or different tone pairs.

In the exemplary application, an implementation can be used whereby each input snippet has different audio characteristics because it contains a single tone. Consecutive input snippets which are one position apart include tones of very different frequencies. To deal with the loss of multiple consecutive frames, snippets that are two and three positions apart in the sequence all contain different tones, purposefully selected. All tones are chosen such that they are within the pass-band of the codec. For example, the pass-band of AMR-WB being 50-7000 Hz. Consecutive tones are chosen to be as different as possible to assist the analysis. Depending on the maximum amount of jitter and frame loss that has to be accommodated, it is possible to use between 4 and 18 different tones.

Figure 2:
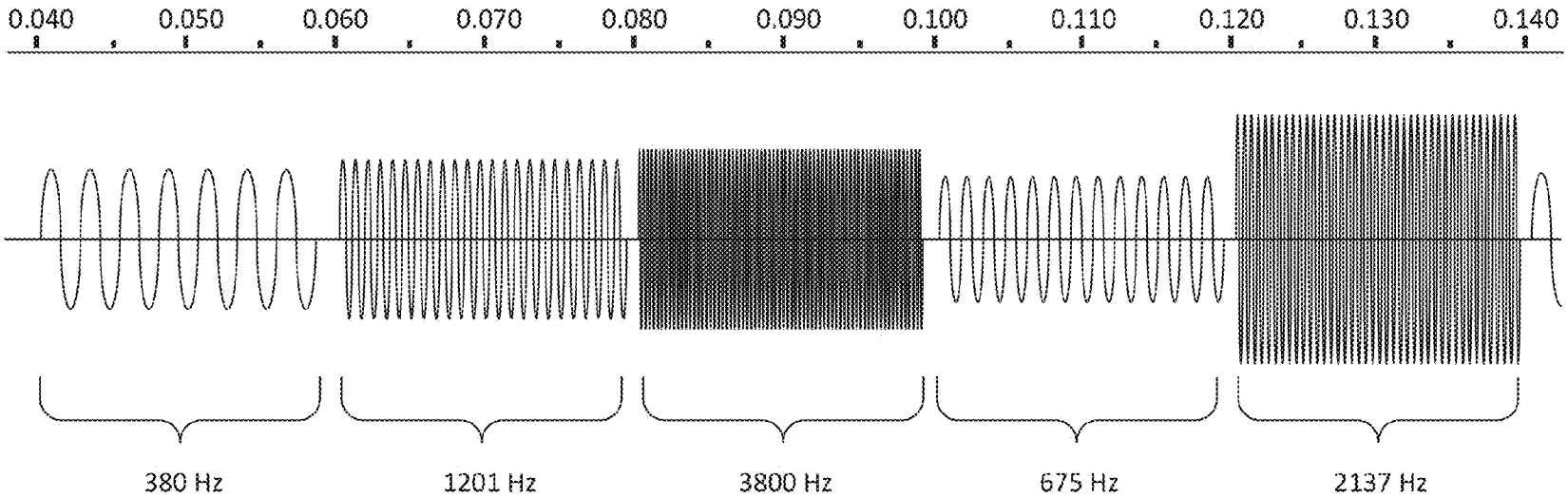
FIG. 2 illustrates a series of input snippets prepared in accordance with an embodiment of a method, each input snippet containing a single tone.

FIG. 2 is an example of a test sequence in accordance with an embodiment including a first few input snippets in the sequence, each snippet including a single tone. Five different tones are shown at 380, 1201, 3800, 675, and 2137 Hz, in that order. The tone frequencies are a ratio of approximately 1.776 apart, but the tone order is chosen to maximize the frequency difference between consecutive tones, which are always different by a ratio of at least 3.2. Input snippets that are two and three positions apart also contain tones with significantly different frequencies. In an embodiment, the amplitude of the snippets is adjusted to result in about equal audio power or volume for the tones after they are encoded and decoded with AMR-WB. In an embodiment, snippets can incorporate short separator segments. As shown, each snippet in the sequence starts and ends with a short silence of about 0.5 ms. Delineating the input snippets by including separator segments in the snippets can assist in aligning the snippets with the time frames of the encoder.

An input sequence of input snippets can be prepared by concatenating a number of different input snippets, and one or more such input sequences can be combined into an input audio signal of a desired duration, for example by repeating an input sequence of input snippets a large number of times. The input signal can then be submitted to an AMR-WB encoder for encoding into a plurality of audio frames, or to any other codec that is of interest. The resulting sequence of audio frames can be stored in a file or immediately transported to a DUT over the LTE interface after encapsulation in RTP packets or packets of another type. Some of the plurality of audio frames may be lost, for example due to intentionally imposed impairments, packet losses on the link, or due to overflow or underrun of a de jitter buffer in the UE. The remaining audio frames are decoded by the UE to generate a continuous internal digital signal that is typically represented as 16-bit PCM. The internal signal can then be captured in digital or analog form via a MHL/HDMI connector or headset jack, for example, on the UE. If the signal is captured in analog form it can be digitized by the system before it is further analysed, for example with the audio interface 112.

Figure 3:
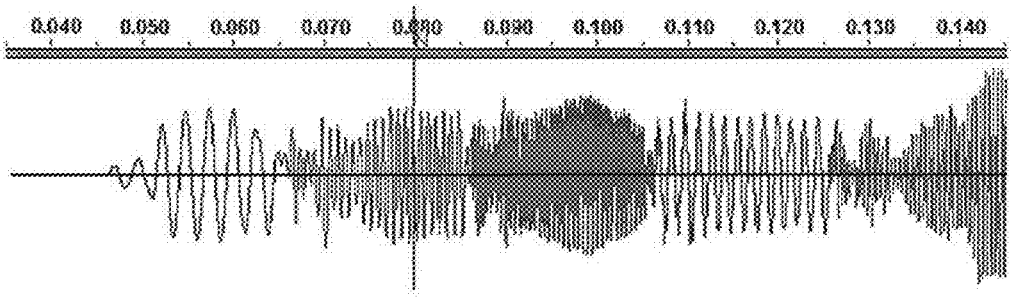
FIG. 3 illustrates an output signal resulting from the plurality of snippets of FIG. 2 that have been encoded as audio frames, transmitted, and decoded with adaptive multi-rate wideband.

The captured signal thus obtained results in a continuous output audio signal. The output audio signal is shown in FIG. 3 for a few frame durations. The tones are not exactly reproduced but can still easily be recognized, by eye, ear, or computer analysis. Each tone lasts about 20 ms, but the sound envelope of the tones has changed and the tones blend together more than they blend together in the input signal of FIG. 2. The output audio signal is delayed with respect to the input signal. The delay indicated in FIG. 3 is only 5 ms, but in an actual test setup the delay can be much longer, due to encoding and decoding delays, transport delays, de jitter buffering, and processing delays. For this reason the input signals and output signals are synchronized before decomposing the output audio signal into a sequence of output snippets. When decomposing the output audio signal into output snippets, those parts of the output signal that are used for alignment, such as leader segments can be removed or otherwise ignored.

The continuous output signal can be decomposed into an output sequence of output snippets by copying short durations of the audio in the output signal that correspond to audio resulting from corresponding durations of the input snippets. It can be desirable to shorten the duration of the output snippets relative to the duration of the input snippets by removing the portions of the audio that correspond to the tone transitions (e.g., corresponding to the separator segments) to avoid incorporating the transitions between frames when determining characteristics of an output snippet, and to accommodate synchronization errors. For the audio shown in FIG. 3, an output snippet duration of 15 ms was used.

Characteristics of one or more of the output snippets created by decomposing at least a portion of the output signal can then be determined. For example, characteristics such as the RMS amplitude (volume) of an output snippet and/or correspondence to a vowel or consonant, can be determined. Further, the snippet audio spectrum can be analyzed to determine if the snippet contains a tones, a di-tone, or a tone pair. The frequency of the tone or tones can then be determined.

For the example output audio signal shown in FIG. 3, the dominant output frequencies of the output snippets are determined to be approximately equal to the input frequencies of corresponding input snippets. The inventor has observed that the frequencies in the output snippets and the frequencies in the corresponding input snippets are typically equal to within a few percent, but sometimes deviations of up to 22% are observed. The accuracy is sufficient to correlate input and output snippets because the tones in the input snippets are chosen to differ by much more than 25%. The inventor has also observed a correlation between the RMS amplitude of the output snippets and the RMS amplitude of the corresponding input snippets.

The usable correlation between the characteristics of the output snippets and the characteristics of the corresponding input snippets allows the characteristics of a specific input and output snippet to be compared to thereby detect if a corresponding audio frame has been lost. If the relevant characteristics of the input and output snippets agree within a predetermined limit or tolerance (i.e. they are sufficiently close) the frame is deemed not to have been lost. However, if one or more important characteristics do not agree within the predetermined limit or tolerance (e.g. they have significantly different values), the disagreement can be taken as an indication that the corresponding audio frame is lost. An embodiment of a system and method can thus be used to count output snippets with and without a lost frame indication and report a corresponding frame loss rate.

Figure 4:
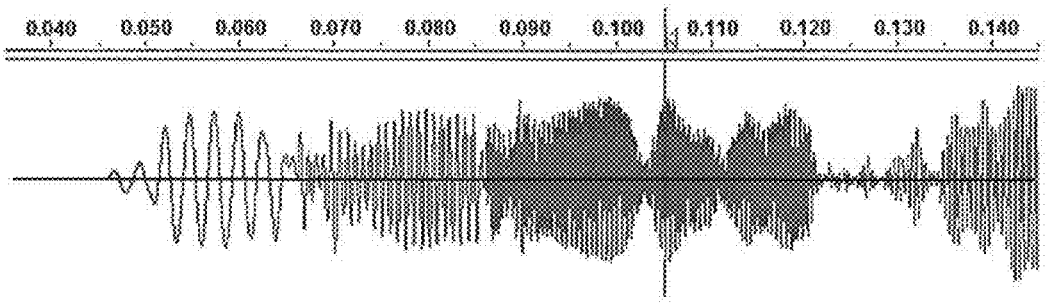
FIG. 4 illustrates the snippets of FIG. 3 wherein an audio frame corresponding to the fourth snippet is lost during the encode, transmit, and/or decode stages.

The output audio signal is shown in FIG. 4 having a frame corresponding to the fourth input snippet from FIG. 2 that is lost. Analysis of the spectrum of the corresponding output snippet determines that a dominant frequency of 3813 Hz, close to the dominant frequency of the third snippet of the input signal. There is not evidence of a frequency in the output signal that corresponds to the input snippet that follows in the input signal (i.e., 675 Hz). Rather, the subsequent dominant frequency determined in the output signal is closer to the third snippet (i.e., 3800 Hz) and thus a characteristic of the output snippet does not agree with a characteristic of the corresponding input snippet. The disagreement is an indication that an audio frame is lost.

Generally, it is straightforward to find the input snippet that corresponds to an output snippet. An output snippet that covers a certain range in time with respect to the synchronization point corresponds to the input snippet that covers the same range. However, under some circumstances it can be harder to find the input snippet that corresponds to an output snippet. For example, the clock of the encoder may run at a slightly different rate from the clock of the decoder, resulting in extra or skipped frames because of an under-run or an over-run of the de jitter buffer. Under such conditions, the later output snippets will correspond to an earlier or later input snippet in the input snippet sequence. Detection of extra or skipped frames can be easily determined, as all frames will appear to be lost after the extra or skipped frame.

Figure 5:
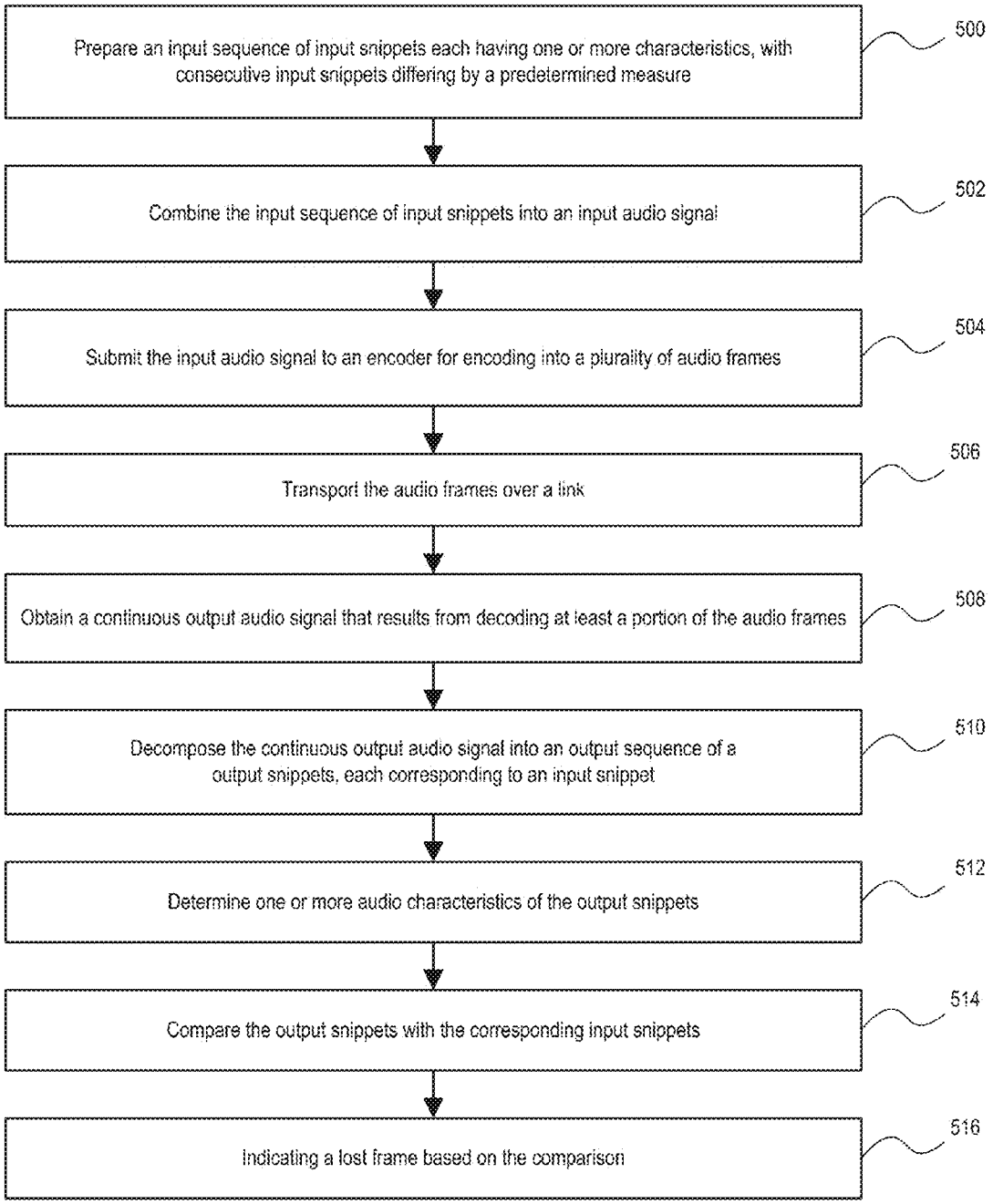
FIG. 5 is a flowchart of a method to detect audio frame losses over a link with a User Equipment, in accordance with an embodiment.

FIG. 5 is a flowchart for an embodiment of a method to detect audio frame losses over a link with a User Equipment. The method includes preparing an input sequence of a plurality of input snippets (Step 500). Each of the input snippet has one or more audio characteristics, and the input sequence is prepared such that consecutive input snippets have one or more audio characteristics that differ by a predetermined measure. The input sequence is combined into an input audio signal (Step 502), which is submitted to an encoder for encoding into a plurality of audio frames (Step 504). The audio frames are transported over the link (Step 506) and a continuous output audio signal is obtained that results from decoding at least a portion of the audio frames (Step 508). The continuous output audio signal is decomposed into an output sequence of a plurality of output snippets, where each output snippet corresponds to an input snippet from the plurality of input snippets of the input sequence (Step 510). One or more audio characteristics of one or more of the output snippets are determined (Step 512) and compared to the one or more audio characteristics of the one or more output snippets with the one or more audio characteristics of corresponding one or more input snippets (Step 514). A lost frame is indicated when the one or more audio characteristics of an output snippet do not agree with the one or more audio characteristics of a corresponding input snippet within a predetermined limit (Step 516).

Embodiment of systems and methods described above include an encoder that is under control of the system. The system can thereby align the input snippets with the frame time boundaries of the encoder. However, embodiments of systems and methods for finding lost frames can be used in a wider scope of applications by relaxing the timing constraints on the input snippets. The method can then be used to detect lost frames in a real-world external voice transport system, such as a third-party cellular system. In such a system, the encoder can be located inside the external voice transport system and not controlled by the system.

Figure 6:
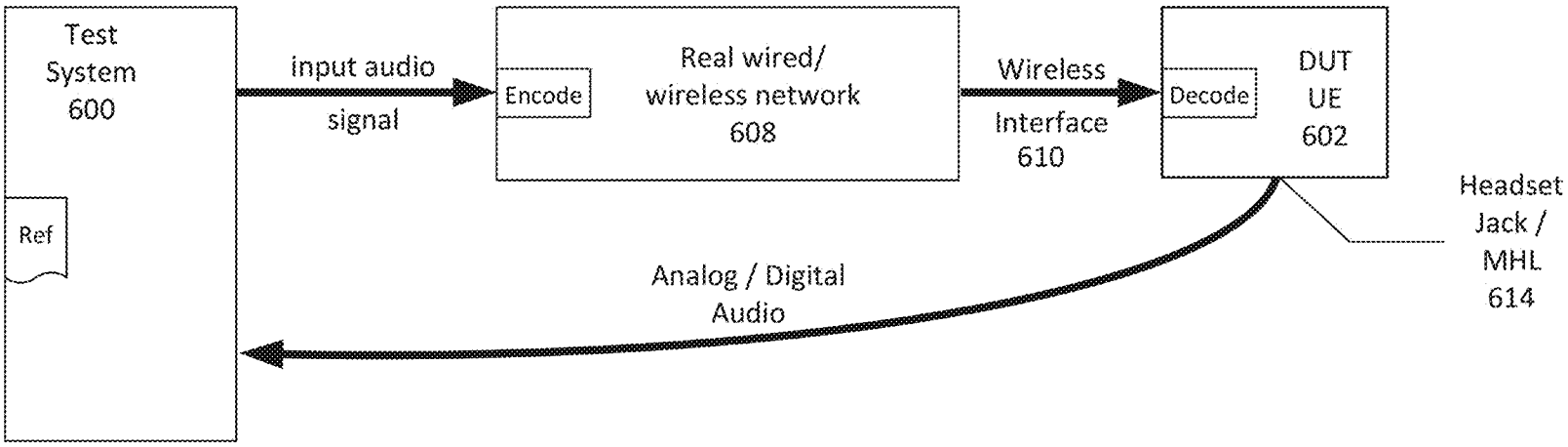
FIG. 6 illustrates an embodiment of a system in accordance with the present invention to detect lost frames in an external network where an encoder is not controlled by the system.

Referring to FIG. 6, an embodiment of a test system 600 and method is shown that can be used to detect lost frames in an external network 608, where the encoder is not controlled by the system. When testing an external transport system, the system can again prepare a sequence of input snippets of different characteristic and combine the snippets into an input audio signal. The snippets can be preceded by a leader segment. The system can then establish a connection to the UE, for example by initiating a VoIP connection, a cellular call, or an Multimedia Broadcast Multicast Service session over a wireless interface 610. Once the connection is established, the system can send the input audio signal to the DUT UE 602, and analyze the resulting audio captured at the headset jack or MHL output 614 of the UE. Since the encoder clock is not controlled by the system, the system cannot make assumptions about the alignment between the input audio signal and the encoder frame boundaries. Moreover, since the system and the encoder use different clocks, the alignment may shift.

If, as in the above example, the input snippet duration is equal to a frame duration, an encoded audio frame will typically contain information from two snippets. When decoded, the resulting output snippet may show the characteristics of two consecutive input snippets. The strength or weight of the characteristics of the two input snippets will depend on the amount of overlap of the snippets with the frame. For example, if the earlier snippet has a 75% overlap with the encoder frame duration, its characteristics will be dominant in the audio output corresponding to the frame. The overlap makes it harder to associate output snippets with frames, because they will tend to align with the input frames. More importantly, the overlap can make it harder to discover missing frames. For example, if the input snippets and encoder frames are aligned carefully such that during one frame duration, only one tone frequency is input into the encoder, a missing frame results in suppression of a tone frequency at the output. However, if input snippets overlap frame boundaries, a tone frequency will appear in two encoded frames. When one of the frames is lost and the other one is retained, the expected frequency will still show up in the output signal, albeit with reduced power.

Embodiments of systems and methods can be used to detect lost frames when the encoder is not under control of the system. In such embodiment, the input snippets can be made shorter in duration than one codec frame duration. For example, referring to FIG. 7, input snippets can have a duration that is a fraction of the frame duration, such as half a duration of one frame. As shown, the encoder frame duration of 20 ms is unchanged while the input snippet corresponding to a single tone is a duration of 10 ms. With the shorter input snippet duration, a single encoder frame will typically overlap with three input snippets and a least one of the input snippets will be fully overlapped by the encoder frame. The encoded frame data will then reflect the characteristics of these three frames. For example, if each input snippet contains a single tone the decoded frame may contain three tones.

Figure 7:
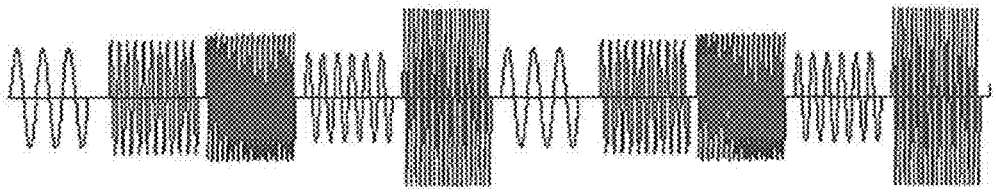
FIG. 7 illustrates a series of input snippets each having a length as long as an audio frame prepared in accordance with an embodiment of a method, each input snippet including a single tone.
Figure 8:
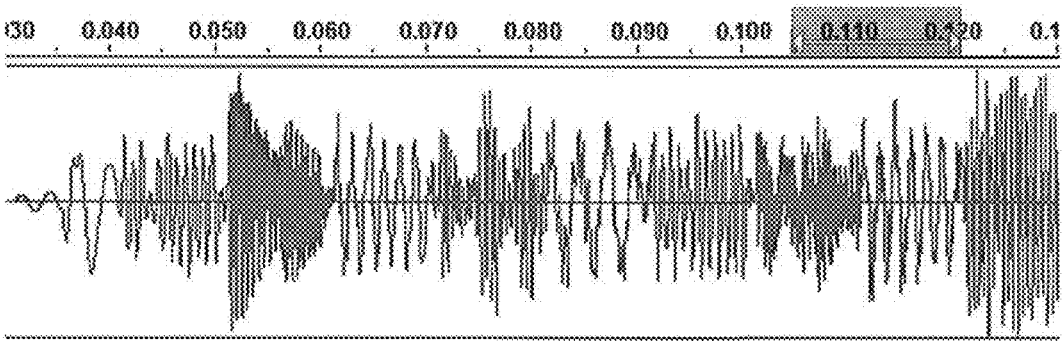
FIG. 8 illustrates an output signal resulting from the plurality of snippets of FIG. 7 that have been encoded as audio frames, transmitted, and decoded with adaptive multi-rate wideband.
Figure 10:
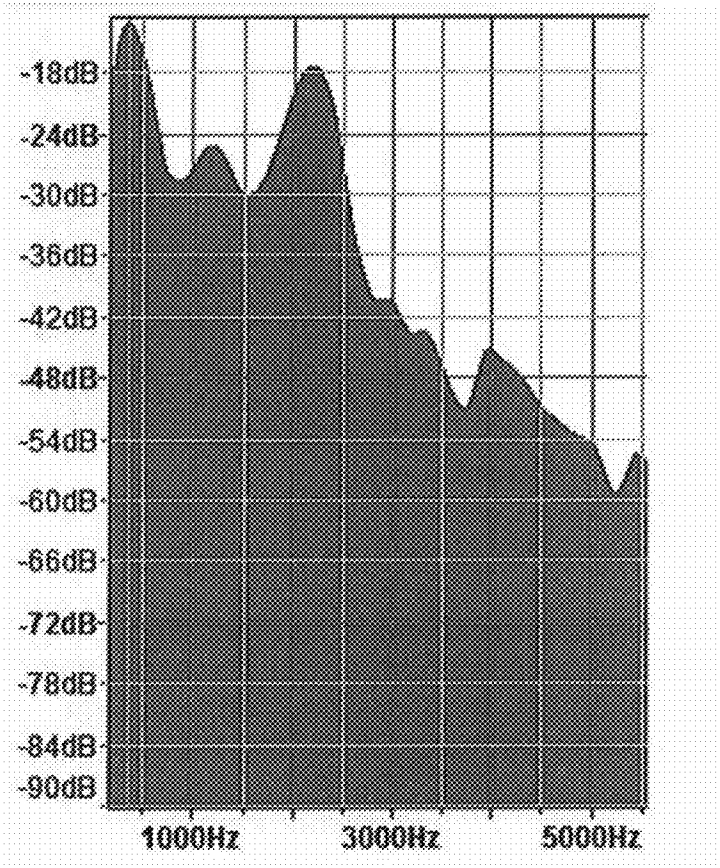
FIG. 10 illustrates the output frequency spectrum for the output signal of FIG. 8 corresponding to one audio frame duration wherein a frame is lost during the encode, transmit, and/or decode stages.
Figure 9:
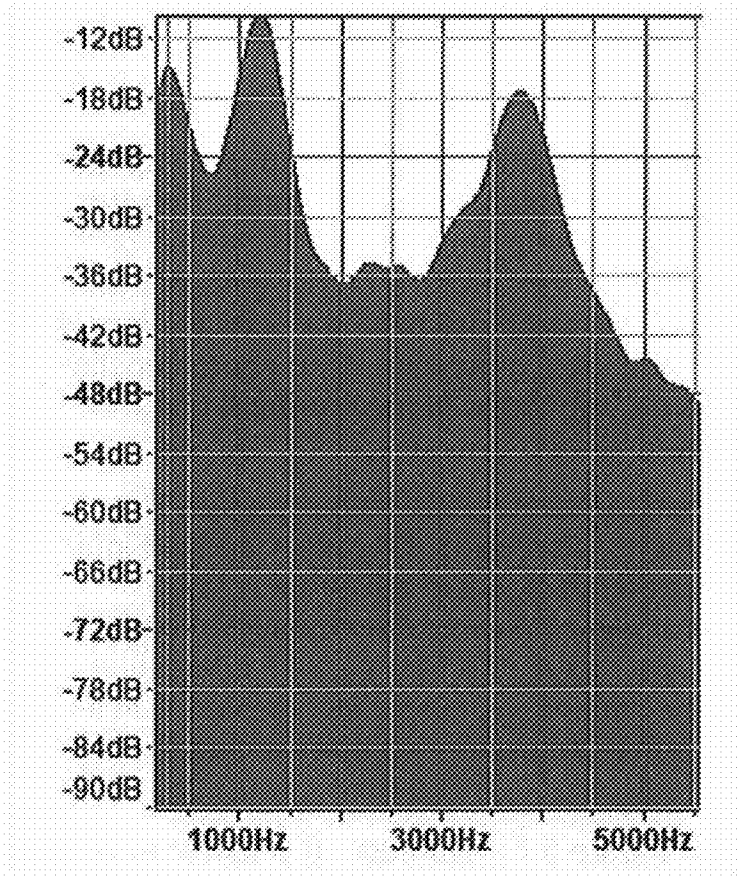
FIG. 9 illustrates an output frequency spectrum for the output signal of FIG. 8 corresponding to one audio frame duration.

FIG. 8 illustrates an example of a decoder output signal corresponding to the input signal of FIG. 7 comprising the shorter input snippets. Each 20 mns period contains several tones. FIG. 9 illustrates an example frequency spectrum of the output signal corresponding to one frame duration. The figure shows three prominent peaks, corresponding to input snippet frequencies of 380, 1201, and 3800 Hz. The encoder frame fully overlaps an input snippet with a 1201 Hz tone, which becomes the dominant tone in the output. Thus, the presence of that frequency in the output signal can be determined. However, if the frame is lost, the dominant peak at 1201 Hz is much suppressed. FIG. 10 illustrates an example frequency spectrum of a frame of the output signal that would be captured at the same time as the frame of FIG. 9, if the frame of FIG. 9 was lost.

Embodiments of a system and method to analyze the continuous output audio signal of the decoder comprises decomposing the output signal into output snippets that have approximately the same duration as the input snippets and synchronizing the sequence of output snippets with the sequence of input snippets. The output snippets need not be synchronized with audio codec frames. As before, the characteristics of the output snippets are determined and compared with characteristics of the corresponding input snippets. If the characteristics in one or two adjacent output snippets do not agree with those of the corresponding input snippets, a lost frame is indicated.

There are multiple methods for obtaining the continuous output signal with the system. In an embodiment, the system can capture the output signal in real time, as shown in FIGS. 1 and 6. In an embodiment, the continuous output signal can be captured in a file that is later uploaded or downloaded to the system for analysis (i.e. for decomposition into output snippets, determination of output snippet characteristics, etc.). In an embodiment, the UE can be programmed to capture the continuous output signal in a file in internal memory UE and to make the captured file available to the system so that the system can obtain the output signal at a later time.

In an embodiment, the direction of the audio in FIG. 6 can be reversed. The system can send the input signal with the sequence of input snippets to the UE, for example via the audio microphone jack, where it is encoded into a sequence of audio frames. The UE can then send the encoded frames to the wired or wireless network, e.g. over a cellular interface, where the frames can be decoded to obtain a continuous output signal. The system can then obtain the continuous output signal from the network for analysis. The system can use the continuous output audio signal to detect lost audio frames on the uplink.

The present invention may be conveniently implemented using one or more conventional general purpose or specialized digital computer, computing device, machine, or microprocessor, including one or more processors, memory and/or computer readable storage media programmed according to the teachings of the present disclosure. Appropriate software coding can readily be prepared by skilled programmers based on the teachings of the present disclosure, as will be apparent to those skilled in the software art.

In some embodiments, the present invention includes a computer program product which is a non-transitory storage medium or computer readable medium (media) having instructions stored thereon/in which can be used to program a computer to perform any of the processes of the present invention. The storage medium can include, but is not limited to, any type of disk including floppy disks, optical discs, DVD, CD-ROMs, microdrive, and magneto-optical disks, ROMs, RAMs, EPROMs, EEPROMs, DRAMs, VRAMs, flash memory devices, magnetic or optical cards, nanosystems (including molecular memory ICs), or any type of media or device suitable for storing instructions and/or data.

The foregoing description of the present invention has been provided for the purposes of illustration and description. It is not intended to be exhaustive or to limit the invention to the precise forms disclosed. Many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. A method to detect audio frame losses in a transmission to a device under test (DUT) over a link, the method comprising:

preparing an input sequence of a plurality of input snippets, wherein each input snippet includes a single tone, the preparing such that consecutive input snippets include tones at frequencies that differ by a predetermined measure;

combining the input sequence of input snippets into an input audio signal;

submitting the input audio signal to an encoder for encoding the input audio signal into a plurality of audio frames;

transmitting the plurality of audio frames to the DUT over the link;

receiving, at the DUT, at least a portion of the plurality of audio frames transmitted over the link;

obtaining an output audio signal that results from decoding the at least a portion of the plurality of audio frames;

decomposing the output audio signal into an output sequence of a plurality of output snippets, where each output snippet corresponds in time to an input snippet from the plurality of input snippets of the input sequence;

determining a tone included in one or more of the output snippets;

comparing the tone included in each of the one or more output snippets with the tone of an input snippet to which the output snippet corresponds in time; and indicating a lost audio frame that was substituted for to obtain the output audio signal when the tone of an output snippet does not agree with the tone of the input snippet to which the output snippet corresponds in time within a predetermined limit.

2. The method of claim 1, wherein at least one of the input snippets includes a separator segment to delineate the at least one of the input snippets within the input sequence.

3. The method of claim 1, wherein the input snippets have a duration corresponding to one audio frame duration.

4. The method of claim 1, wherein the input snippets have a duration corresponding to a fraction of one audio frame duration.

5. The method of claim 1, wherein a plurality of output snippets has a duration that is shorter than the duration of the corresponding input snippets.

6. The method of claim 1, wherein the one or more characteristics of the one or more input snippets include average audio input power;

wherein the tone included in the one or more output snippets includes average audio output power;

wherein the comparing the tones included in the one or more output snippets with the tones included in corresponding one or more input snippets includes comparing the average audio input power of the one or more input snippets and the average audio output power of the one or more output snippets; and wherein the indicating a lost audio frame that was substituted for to obtain the output audio signal when tone included in an output snippet does not agree with tone included in a corresponding input snippet within a predefined limit comprises indicating a lost audio frame that was substituted for to obtain the output audio signal if the average audio input power does not agree with the average audio output power within the predetermined limit.

7. The method of claim 1, wherein the preparing the sequence of input snippets comprises preparing the sequence of input snippets such that input snippets that are two positions apart in the sequence have one or more audio characteristics that differ by one or more of a predetermined measure.

8. The method of claim 7, wherein the preparing the sequence of input snippets further comprises preparing the sequence of input snippets such that input snippets that are three positions apart in the sequence have one or more audio characteristics that differ by one or more of a predetermined measure.

9. The method of claim 1, wherein the plurality of audio frames is a plurality of adaptive multi-rate (AMR) frames and wherein the decoding is performed by the DUT and wherein the continuous output audio signal is obtained from an analog or a digital audio output on the DUT.

10. A system to detect audio frame losses in a transmission to a device under test (DUT) over a link, the system comprising:

an audio signal encoder; and one or more processors usable to prepare an input sequence of a plurality of input snippets, wherein each input snippet includes a single tone, such that consecutive input snippets include tones at frequencies that differ by a predetermined measure, combine the input sequence of input snippets into an input audio signal;

submit the input audio signal to an encoder for encoding the input audio signal into a plurality of audio frames, transmit the plurality of audio frames to the DUT over the link, obtain an output audio signal that results from decoding at least a portion of the plurality of audio frames, the at least a portion of the plurality of audio frames being received at the DUT;

decompose the output audio signal into an output sequence of a plurality of output snippets, where each output snippet corresponds in time to an input snippet from the plurality of input snippets of the input sequence, determine a tone included in of one or more of the output snippets, compare the tone included in each of the one or more output snippets with the tone of an input snippet to which the output signal corresponds in time, and indicate a lost audio frame that was substituted for to obtain the output audio signal a lost frame when tone of an output snippet does not agree with one or more audio characteristics of the input snippet to which the output signal corresponds in time within a predetermined limit.

11. The system of claim 10, wherein at least one of the input snippets includes a silence to delineate the at least one of the input snippets within the input sequence.

12. The system of claim 10, wherein the tones included in the one or more input snippets include average audio input power;

wherein the tones included in the one or more output snippets includes average audio output power;

wherein the compare step comprises comparing the average audio input power of the one or more input snippets and the average audio output power of the one or more output snippets; and wherein the indicate step comprises indicating a lost audio frame that was substituted for to obtain the output audio signal if the average audio input power does not agree with the average audio output power within the predetermined limit.

13. The system of claim 10, wherein the plurality of audio frames is a plurality of adaptive multi-rate (AMR) frames and wherein the decoding is performed by the DUT and wherein the continuous output audio signal is obtained from an analog or a digital audio output on the DUT.

14. A non-transitory machine readable medium having instructions thereon that when executed cause a system for detecting audio frame losses in a transmission to a device under test (DUT) over a link to:

prepare an input sequence of a plurality of input snippets, wherein each input snippet includes a single tone, such that consecutive input snippets include tones at frequencies that differ by a predetermined measure, combine the input sequence of input snippets into an input audio signal;

submit the input audio signal to an encoder for encoding the input audio signal into a plurality of audio frames, transmit the plurality of audio frames to the DUT over the link, obtain an output audio signal that results from decoding at least a portion of the plurality of audio frames, the at least a portion of the plurality of audio frames being received at the DUT;

decompose the output audio signal into an output sequence of a plurality of output snippets, where each output snippet corresponds in time to an input snippet from the plurality of input snippets of the input sequence, determine a tone included in one or more of the output snippets, compare the tone included in each of the one or more output snippets with the tone included in an input snippet to which the output signal corresponds in time, and indicate a lost audio frame that was substituted for to obtain the output audio signal when tone included in an output snippet does not agree with the tone included in the input snippet to which the output signal corresponds in time within a predetermined limit.

15. The non-transitory machine readable medium of claim 14, having further instructions thereon that when executed cause a system for detecting audio frame losses over a link with a UE:

wherein the tones included in the one or more input snippets include average audio input power;

wherein the tones included the one or more output snippets includes average audio output power;

wherein the compare step comprises comparing the average audio input power of the one or more input snippets and the average audio output power of the one or more output snippets; and wherein the indicate step comprises indicating a lost audio frame that was substituted for to obtain the output audio signal if the average audio input power does not agree with the average audio output power within the predetermined limit.

16. The non-transitory machine readable medium of claim 14, having further instructions thereon that when executed cause a system for detecting audio frame losses over a link with a UE:

wherein the plurality of audio frames is a plurality of adaptive multi-rate (AMR) frames and wherein the decoding is performed by the DUT and wherein the continuous output audio signal is obtained from an analog or a digital audio output on the DUT.

* * * * *